United States Patent [19]

Rassi

[11] Patent Number: 4,902,042

[45] Date of Patent: Feb. 20, 1990

[54] CALENDAR

[75] Inventor: Antti E. Rassi, Helsinki, Finland

[73] Assignee: Outokumpu Oy, Helsinki, Finland

[21] Appl. No.: 145,765

[22] PCT Filed: May 16, 1986

[86] PCT No.: PCT/FI86/00050

§ 371 Date: Jan. 5, 1988

§ 102(e) Date: Jan. 5, 1988

[87] PCT Pub. No.: WO87/06886

PCT Pub. Date: Nov. 19, 1987

[51] Int. Cl.[4] ..... B42D 5/04; B42D 15/00; B41L 1/24; G09D 3/04

[52] U.S. Cl. ..... 283/2; 283/105; 282/22 A; 40/121

[58] Field of Search ..... 283/2, 43, 38, 40, 63 A, 283/105; 402/19; 40/107, 358, 121, 530, 533; 281/38; 282/22 A

[56] References Cited

U.S. PATENT DOCUMENTS

| | | | |
|---|---|---|---|
| 467,117 | 1/1892 | Hawkins | 40/121 |
| 553,503 | 1/1896 | Bengough | 282/22 A |
| 1,330,730 | 2/1920 | Thompson | 283/105 |
| 2,068,214 | 1/1937 | Winford | 40/121 |
| 2,210,022 | 8/1950 | Bunto | 402/19 |
| 2,526,575 | 10/1950 | Neal | 402/19 |
| 2,529,367 | 11/1950 | Baumgarth | 40/121 |
| 2,677,556 | 5/1954 | Hill | 283/63 A |
| 4,342,167 | 8/1982 | Stanard | 40/121 |

FOREIGN PATENT DOCUMENTS

| | | | |
|---|---|---|---|
| 914274 | 10/1946 | France | 283/63 A |
| 165512 | 11/1933 | Switzerland | 283/2 |

*Primary Examiner*—Douglas D. Watts
*Assistant Examiner*—Paul M. Heyrana
*Attorney, Agent, or Firm*—Dellett, Smith-Hill and Bedell

[57] ABSTRACT

The invention relates to a calendar comprising pages for calendar information, illustrations and text, where the pages are attached together so that by turning a page, the next page is advantageously revealed. In the pages (3) containing calendar information, the calendar section (5) proper and the section (6) containing illustrations and/or text can be detached from each other. Moreover, the calendar may contain pages provided with other than calendar information, as well as a binding which is essentially of the same size as the section (6) remaining after the calendar information (5) has been removed. After the period of active use, the calendar can be used as a book.

11 Claims, 1 Drawing Sheet

CALENDAR

Figure 1:
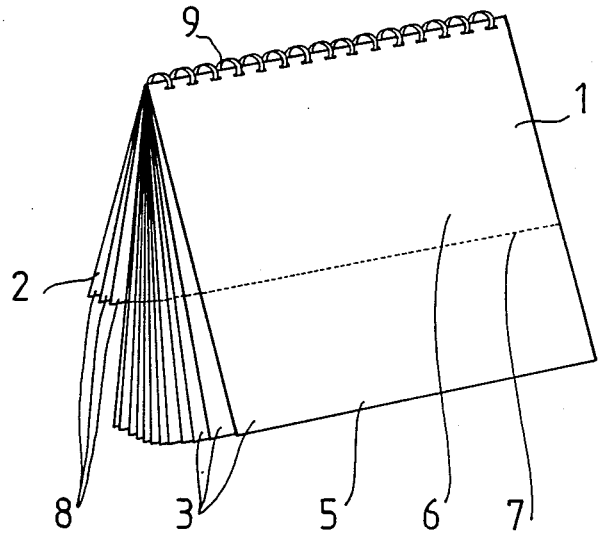

The present invention relates to a calendar which is essentially composed of the relevant calendar information and advantageously of pages provided with illustration and/or text, the pages being attached together so that by turning a page, the next page is profitably revealed.

The general practise with calendars is such that each page contains an illustration, usually a photograph or a drawing, as well as the essential yearly, monthly, weekly and daily calendar information. Each period of time may be allotted a page of its own. The pages are generally attached together so that the top ends are stapled together, and below the stapling there is a perforation by aid of which the page containing out-of-date information can be torn off after the respective period of time has elapsed.

In the prior art there also are calendars where the top ends of the pages are attached together by employing a spiralling structure, around which the pages can be turned. Often the illustrations and/or information contained in the calendars are so valuable that they are kept even after their active use.

A calendar may also be formed of postcard-size pictures, the calendar information being provided below the picture. The calendar information can be removed, for instance by cutting with scissors, and the pictures can be detached from the joining piece by means of the perforation. As a result, a number of postcards is obtained.

Futhermore, there are calendars which are bound in book-form and are kept on the table; they contain pictures and possibly some useful information. After its active use, this kind of calendar can be kept in the bookcase.

The DE Patent Publication No. 2 855 726 introduces an illustrated calendar and an adjoining folder. There the back page of the calendar, or the folder, serves as an interchangeable frame for the illustrations. Although calendars are relatively expensive and often contain elaborate and valuable illustrations and possibly an amount of useful information, they are generally disposed of after active use. People don't want to keep them, because at this stage the illustrated pages are usually torn off and become smudgy. Moreover, the calendar information provided at the bottom or on the side of the pictures is no more relevant. Even if the calendar information were removed from the rest of the calendar, for instance by cutting, the structure of conventional calendars is such that they are worn off after their active use, and they cannot be stored in bookform. Often the illustration and the calendar information provided on the same page of the calendar together require so much space that an out-of-date calendar is difficult to store owing to its large size. In addition, a one-year collection, i.e. 12 pictures, may be too limited for preserving.

The object of the present invention is to eliminate some of the drawbacks of the prior art and to achieve a better and more feasible calendar by improving the structure of the calendar so that part of it can be advantageously used as a book even after the active period of use. The essential novel features of the invention are apparent from the appended patent claims.

The calendar according to the present invention is composed of pages, each period of time being allotted on page which is formed of two sections: one containing the illustrations and/or the text, and the other containing the calendar information. The calendar information section can be detached from the rest of the page. The calendar may also contain other pages provided with text and/or illustrations, these pages being of the same size as the remaining sections of the pages with calendar information, after the calendar information section has been removed. The pages are attached together so that they can be advantageously turned when the next page is wanted clearly on show. Furthermore, the calendar can be provided with a binding which advantageously matches the calendar after the section containing calendar information has been removed.

A noteworthy advantage of the present invention is the fact that after active use, the calendar may be kept as a book. After removing the calendar information, the calendar serves, in reduced size, as an art, science or photography album or a useful handbook. The number of pages in the book can be increased by dividing the calendar period into suitable shorter periods of time, as well as by advantageously adding other pages containing illustrations and/or text, these additional pages being of the same size as the calendar pages after the section of calendar information has been removed. When covered with a binding, the calendar book is kept neat and tidy.

Figure 2:
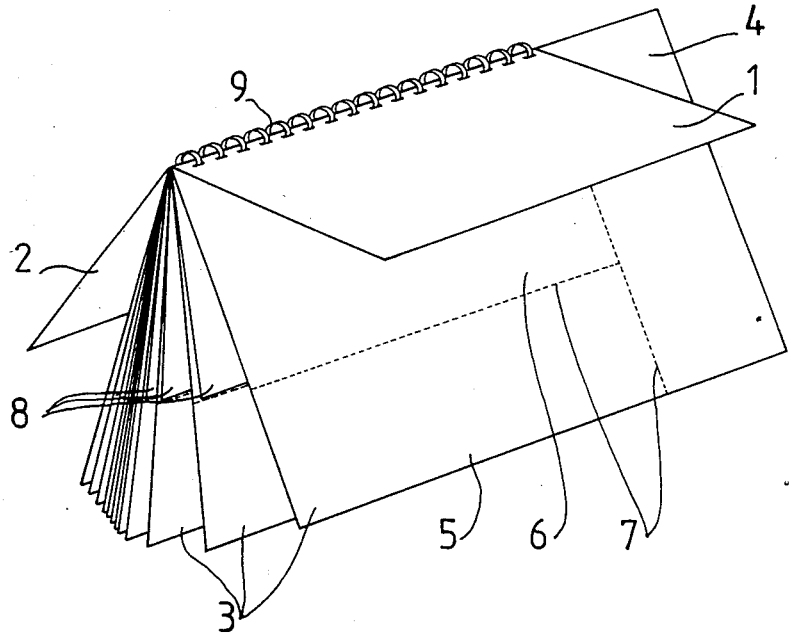

In the following the invention is described in more detail with reference to the appended drawing, where FIG. 1 is an illustration of a preferred embodiment of the invention, and FIG. 2 is an illustration of another preferred embodiment of the invention.

FIG. 1 is a schematical illustration of a calendar where the pages 3 containing the relevant calendar information are formed of the section 6 provided with illustration and/or text and of the section 5 provided with the calendar information of a specific period of time. The sections 5, 6 can be detached from each other by means of the perforation 7. After the pages 3 containing the calendar information proper, there are extra pages 8 containing additional information. The calendar pages 3, 8 are attached together by means of a spiral binder 9. That section of the first page which is provided with illustration and text serves as the front cover 1, and the last page of the calendar serves as the back cover 2.

In the embodiment according to FIG. 2, there are provided the front cover 1 and the back cover 2. The pages 3 containing the calendar information are formed of the calendar information 4 and 5 of two successive periods, as well as of the illustrated section 6. The sections can be detached from each other by means of the perforation 7. In between the calendar pages 3 proper, there are extra pages 8 containing additional text. The pages 3, 8 and the covers 1, 2 are attached together by means of a spiral binder 9. While employing the calendar of the invention illustrated in FIG. 2, the calendar information corresponding to an outdated period is removed by tearing it off. At the first stage, according to the drawing, there is removed the calendar information placed on the right-hand side of the calendar. During the next period, the calendar information located at the bottom of the page is respectively removed. When the period of active use has elapsed, the remaining pages advantageously form a book provided with text and illustrations.

It is particularly pointed out that the uniform periods of time provided with calendar information can be chosen according to the desired volume of the book. For example, if the chosen calendar period is one week and the calendar covers one year, the volume of the book is at least 52 pages. The calendar can also cover several years, in which case for instance a two-year calendar with monthly periods makes a book with at least 24 pages.

The calendar of the invention may contain information connected to the illustrations of the photographs. In addition to the illustrations, or instead of them, the calendar may contain information from a special field, for instance useful tables, public relations information or food recipes. The successive issues of the calendar of the invention may advantageously form an essentially uniform collection of books.

What is claimed:

1. A calendar comprising:

a plurality of sheets each having at least a first portion, which bears calendar information, and a second potion, which bears other than calendar information, attachment means whereby the sheets are attached together so that successive sheets can be revealed by turning the preceding sheets, the attachment means engaging the second portions of the sheets but not the first portions thereof, and the first portion of each sheet consisting of at least first and second parts weakened along two perpendicular lines allowing ready detachment of the first part and second part of the first portion from the second portion thereof to form a book comprising the attachment means and the second portion of the sheets, and a cover which is engaged by the attachment means and of which the size and shape correspond substantially to the second portion of each sheet.

2. A calendar according to claim 1, comprising at least one additional sheet of substantially the same size and shape as the second portion of one of the sheets of said plurality, the additional sheet bearing other than calendar information and being engaged by the attachment means.

3. A calendar according to claim 1, wherein the first portion of each sheet contains calendar information of at least one calendar period.

4. A calendar according to claim 1, wherein the first portion of each sheet contains calendar information for two successive, equally long calendar periods.

5. A calendar according to claim 1, wherein both the first and second portions of a sheet are revealed by turning the preceding sheets.

6. A calendar comprising:

at least one cover sheet, a first group of sheets each having at least a first portion, which bears calendar information, and a second portion, which bears other than calendar information, the second portion of each sheet of the first group being of substantially the same size and shape as the cover sheet, a second group of sheets, each of substantially the same size and shape as the cover sheet, attachment means engaging the cover sheet, each sheet of the first group, and each sheet of the second group, whereby the cover sheet and the first and second groups of sheets are attached together, with the cover sheet and the second group of sheet substantially coterminous with the second portion of the first group of sheets, the attachment means engaging the second portions of the sheets of the first group but not the first portions thereof, whereby the first portion of each sheet of the first group can be detached from the second portion of that sheet, so that on removal of all of the first portions a book having sheets of substantially uniform shape and size is formed.

7. A calendar according to claim 6, wherein the first portion of each sheet of the first group bears calendar information for at least one calendar period.

8. A calendar according to claim 6, wherein the first portion of each sheet of the first group bears calendar information for two successive, equally long calendar periods.

9. A calendar according to claim 6, wherein both the first and second portions of a sheet of the first group are revealed by turning the preceding sheets.

10. A calendar according to claim 6, wherein the first portion of each sheet of the first group has at least first and second parts, and each such sheet is weakened along two lines allowing ready detachment of the first part of the first portion and the second part of the first portion respectively.

11. A calendar according to claim 10, wherein said two lines are mutually perpendicular, one line having the first part of the first portion at one side and both the second part of the first portion and the second portion at an opposite side, and the other line having the second portion at one side and the second part of the first portion at an opposite side.

* * * * *